United States Patent [19]

Masson

[11] Patent Number: 5,045,017

[45] Date of Patent: Sep. 3, 1991

[54] PEOPLE ENTERTAINMENT WITH HAND-HELD SOUND-EMITTING DEVICES

[76] Inventor: Rudy Masson, 4015 W. Verdugo, Burbank, Calif. 91505

[21] Appl. No.: 504,653

[22] Filed: Apr. 4, 1990

[51] Int. Cl.[5] ..... A63H 5/00

[52] U.S. Cl. ..... 446/415; 446/421

[58] Field of Search ..... 446/415, 418, 420, 421, 446/422, 397, 486, 265; 428/4, 5; 40/586

[56] References Cited

U.S. PATENT DOCUMENTS

| | | | |
|---|---|---|---|
| 1,509,956 | 9/1924 | Kipp | 446/418 |
| 3,221,444 | 12/1965 | Hettinga | 446/397 |
| 3,439,446 | 4/1969 | Alonso | 446/266 |

*Primary Examiner*—Mickey Yu

*Attorney, Agent, or Firm*—Benoit Law Corporation; 10

[57] ABSTRACT

A people entertainment method provides a sound-emissive, tear-resistant sheet of material, bends that sound-emissive sheet of material into a loop and attaches that loop to a handle. Users may then hold the handle and shake that handle and thereby the loop intensively to excite the bent sheet into sound emission. Streamer elements may be connected to the handle which is shook intensively to excite the bent sheet into sound emission accompanied by shaking streamer elements. There further may be provided on the sound-emissive, tear-resistant sheet of material, a message visually perceptible by people being entertained and related to an aspect of the practiced people entertainment. People's attention may then be drawn to that message by exciting the bent sheet into sound emission through the shaking of the handle and thereby of the loop on which the message is provided.

22 Claims, 2 Drawing Sheets

PEOPLE ENTERTAINMENT WITH HAND-HELD SOUND-EMITTING DEVICES

FIELD OF THE INVENTION

The subject invention relates to people entertainment and merriment at sporting events and other occasions and, more specifically relates to the provision and use of hand-held noisemakers and streamers.

BACKGROUND OF THE INVENTION

Various noisemakers have become known through the ages. Some are hand held, such as the familiar rattle and the maraca, while others are suspended, such as the familiar thunder sheet used in theaters to produce sounds representing thunder, artillery fire, explosions or other noises.

On the other hand, the familiar pompom girl has to use her voice at high pitch for the sound accompaniment of her routines which typically include the waving of large flowerlike clusters or streamers resembling pompoms at football or baseball games or on other occasions. That often puts undue strain on the laryngopharyngeal tract.

Also, where streamers are used, increased synchronization between the visual impression perceived from shaking streamers and an accompanying sound would be desirable. In this respect, it is possible to generate a whooshing or rustling sound by intensely shaking certain pompons or streamers. However, such hissing, rushing or rustling sounds cannot even remotely approach the sound expression of a thunder sheet and is definitely different in kind therefrom. Rather, cheerleaders and pompom girls need to underscore vocally the visual impression they are conveying to the audience.

Team colors and logos are often in display on clothing, banners, and other objects separate from the shaking streamers or from any noisemakers other than perhaps the cheerleaders themselves. Similar considerations apply to birthday parties, New Year's celebration and other festive event, where the message appears on cakes, balloons, signs, posters and the like.

In these and similar situations, an audio-visual display, so to speak, from one and the same moving object would be very helpful in conveying the message more visibly and more memorably.

SUMMARY OF THE INVENTION

It is a general object of the invention to overcome the disadvantages and to meet the needs expressed or implied in the Background of the Invention or in other parts hereof, and to solve in that area other heretofore unsolved problems or satisfy other heretofore unmet needs.

It is a germane object of this invention to provide improved people entertainment methods and devices.

It is a related object of this invention to provide improved manually actuable sound-emissive devices, and to provide improved methods for their manufacture or use.

It is also an object of this invention to provide improved audio-visual expressions of team colors, logos, and other messages to people being entertained.

Other objects of the invention will become apparent in the further course of this disclosure.

The subject invention resides in a people entertainment noisemaker method, and resides, more specifically, in the improvement comprising in combination the steps of providing a single sound-emissive, tear-resistant sheet of material, bending that sound-emissive sheet of material into a single loop around a space running transversely to said loop and being open to atmosphere laterally of said loop, and attaching that loop to a handle.

From a related aspect thereof, the invention resides in such a method, including further the steps of holding the handle, and shaking the handle and thereby the loop intensively to excite the bent sheet into sound emission.

When streamer elements are connected to the handle, which is shook, the bent sheet is excited into sound emission accompanied by shaking streamer elements for an audiovisual kind of expression.

According to a related aspect of the invention, the sound-emissive, tear-resistant sheet of material is provided with a message visually perceptible by people being entertained and related to an aspect of the people entertainment practiced at the time. By shaking the handle and thereby the loop intensively, people's attention is drawn to the message by exciting the bent sheet into sound emission through such shaking.

The invention similarly resides in a people entertainment noisemaker device, comprising in combination a handle, and a single loop of a single sound-emissive, tear-resistant sheet of material attached to that handle said loop bent around a space running transversely to said loop and being open to atmosphere laterally of said loop.

From a related aspect thereof, the invention resides in a people entertainment noisemaker device, comprising in combination a handle, a single loop of a single sound-emissive, tear-resistant sheet of material attached to that handle said loop bent around a space running transversely to said loop and being open to atmosphere laterally of said loop, and a message visually perceptible on that sound-emissive, tear-resistant sheet of material by people being entertained and related to an aspect of the people entertainment performed by that device.

In either case, streamer elements may be connected to the handle, either directly or indirectly through the sheet.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
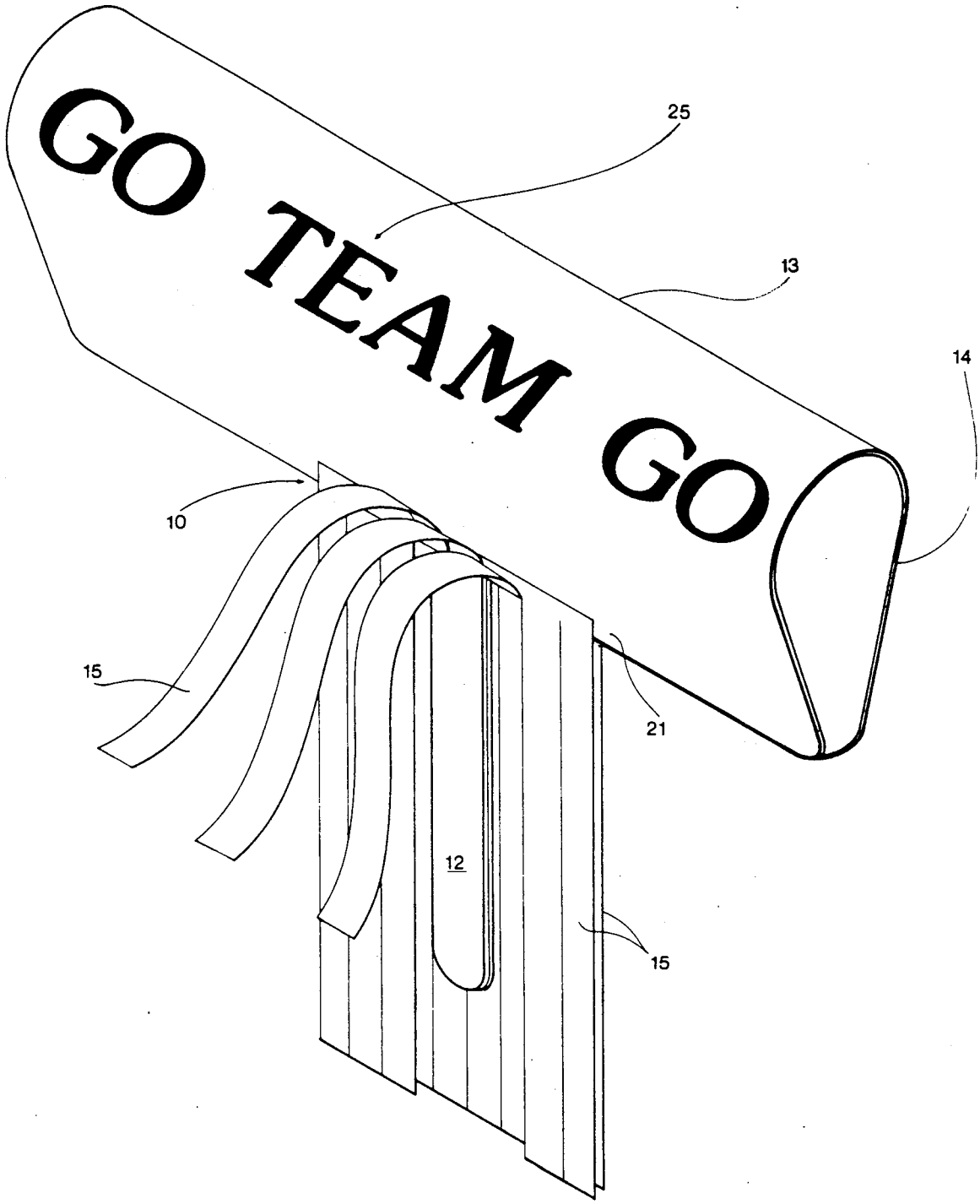
FIG. 1 is a perspective view of a people entertainment device according to a preferred embodiment of the invention.

The drawings show a people entertainment device 10 comprising a handle 12 and a loop 13 of a sound-emissive, tear-resistant sheet of material 14 attached to that handle.

It may be said that the sheet 14 is a kind of thundersheet, as it emits noise upon shaking when bent into the loop 13. Several materials are useful for this purpose. By way of example, we have used a 5 mil sheet of no-tear polyester, which emits a loud noise when the loop 13 is shook intensely back and forth. Other suitable materials include stiff Mylar and the like. In addition to being tear-resistant, these materials are also waterproof for outdoor use.

People entertainment devices according to the subject invention may be made by providing the sound-emissive, tear-resistant sheet of material 14, bending that sound-emissive sheet of material into a loop 13, and attaching that loop to the handle 12. As apparent from the drawings, the sheet 14 is bent around a space running transversely to the loop 13 and being open to atmopshere laterally of that loop 13.

Users may then hold the handle and shake such handle 12 and thereby the loop 13 intensively to excite the bent sheet 14 into sound emission. A human hand (not shown) may be used for that purpose.

Streamer elements 15 may be connected to the handle. These streamer elements typically are more limp than the sheet 14. By comparison, the sheet 14 may be called stiff, even though the loop 13 flexes when shook and accordingly emits sound.

By holding the handle and shaking that handle 12 and thereby the streamer elements 15 and the loop 13 intensively, the bent sheet 13 is excited into sound emission accompanied by shaking streamer elements for an audio-visual effect of sorts.

Figure 2:
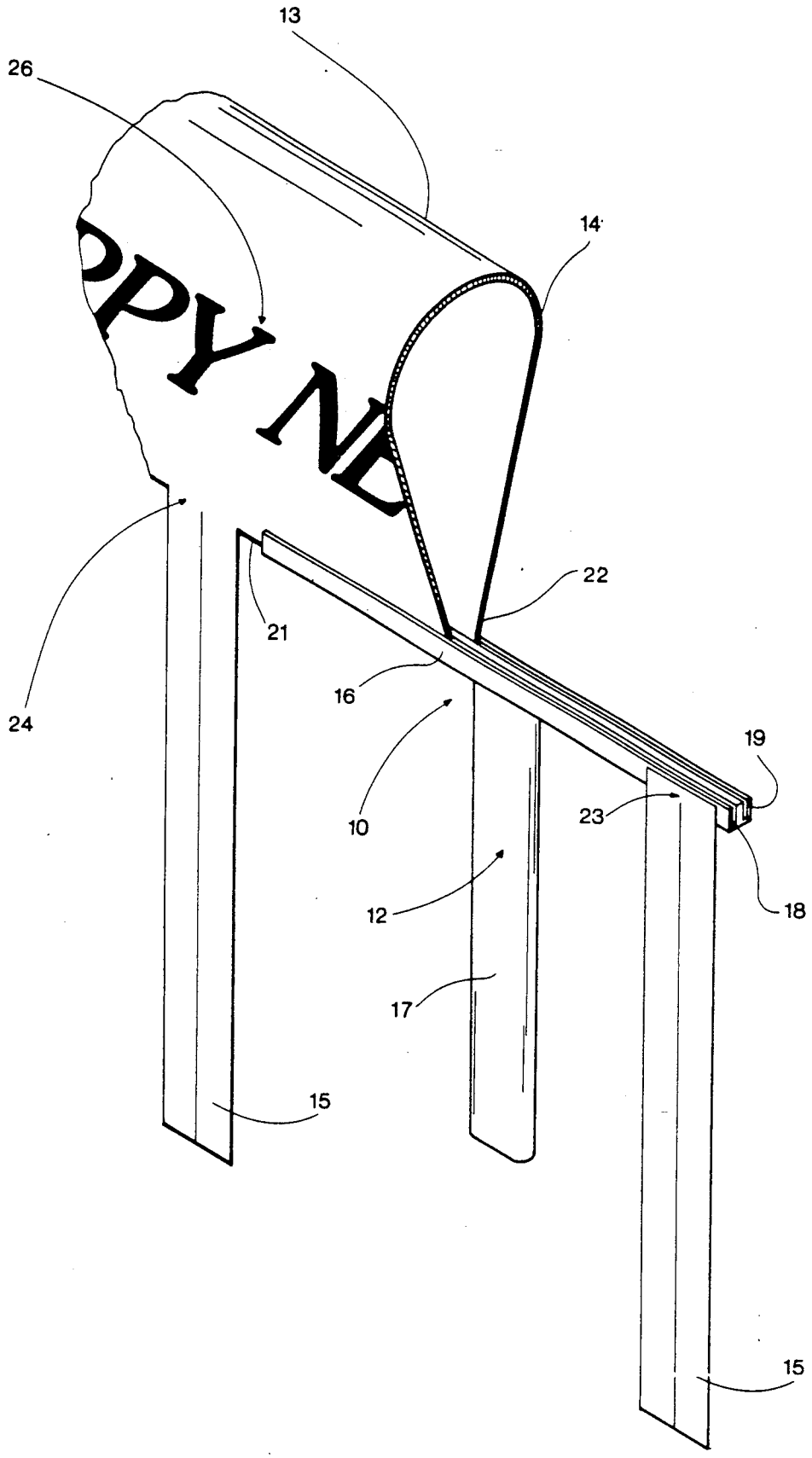
FIG. 2 is a similar view, with parts broken away, showing details and modifications of the device shown in FIG. 1.

According to the embodiment shown in FIG. 2, which may also be used in FIG. 1, the handle 12 is provided with a crosspiece 16, which may be considered as part of the handle. The loop is attached to that crosspiece 16 of the handle. The handle 12 may have a handgrip 17 below the crosspiece 16, such as shown in FIG. 2.

The handle or crosspiece may have grooves 18 and 19 into which opposite edges 21 and 22, respectively, of the sheet 14 are inserted or in which they are otherwise held, such as by an adhesive or other fastening method. If the handle or crosspiece are of a plastics material, the crosspiece 16 may be heat-sealed onto the sheet edges 21 and 22. On the other hand, staples or other fasteners (not shown) may be used to attach the sheet 14 at marginal edges 21 and 22 to the handle or crosspiece.

It is thus seen that the handle 12 may be provided with a T-shaped configuration and the loop 13 or marginal sheet edges 21 and 22 may be attached to a top of such T-shaped configuration.

The streamer elements 15 may be attached to the handle 12 or to its crosspiece as shown at 23 in FIG. 2. Alternatively, the streamer elements 15 may be attached to the sheet 14 which is attached to the handle, as in FIG. 1. The streamer elements 15 may be integral with the sheet 14 which is attached to the handle, such as shown at 24 in FIG. 2.

As shown in FIGS. 1 and 2, the sound-emissive, tear-resistant sheet of material 14 may be provided with a message 25 or 26 visually perceptible by people being entertained and related to an aspect of the people entertainment practiced at the time. The handle may again be held and shook. Shaking of the handle 12 and thereby the loop 13 will draw people's attention to the message 25 or 26 by exciting the bent sheet 14 into sound emission through such shaking.

In this manner, team colors, logos, names of bands, designations of festive occasions, and all kind of other messages can be more effectively projected, since such message is not only shaking, but is also accompanied by the sound emission of the shaking sheet 14, to which may be added the visual "noise" of shaking streamers 15.

Since, according to Marshall McLuhan "The message is in the medium," the shaking and sound emitting device according to the subject invention is thus a better medium to convey the message 25, 26, etc., provided thereon, such as by printing or other application to the sheets 14. There thus is a structural and functional relationship between the message 25 or 26 and the remainder of the device 10 or of any other device within the scope of the subject invention.

The subject extensive disclosure will render apparent or suggest to those skilled in the art various modifications and variations within the spirit and scope of the subject invention and equivalents thereof.

I claim:

1. In a people entertainment noisemaker method, the improvement comprising in combination the steps of:

providing a single sound-emissive, tear-resistant sheet of material;

bending said sound-emissive sheet of material into a single loop around a space running transversely to said loop and being open to atmosphere laterally of said loop; and attaching said loop to a handle.

2. A method as in claim 1, including the steps of:

holding said handle; and shaking said handle and thereby said loop intensively to excite said bent sheet into sound emission.

3. A method as in claim 1, including the step of:

connecting streamer elements to said handle.

4. A method as in claim 3, including the step of:

holding said handle; and shaking said handle and thereby said streamer elements and said loop intensively to excite said bent sheet into sound emission accompanied by shaking streamer elements.

5. A method as in claim 3, wherein:

said streamer elements are attached to said handle.

6. A method as in claim 3, wherein:

said streamer elements are attached to said sheet which is attached to said handle.

7. A method as in claim 3, wherein:

said streamer elements are integral with said sheet which is attached to said handle.

8. A method as in claim 1, including the steps of:

providing said handle with a crosspiece; and attaching said loop to said crosspiece of the handle.

9. A method as in claim 8, including the step of:

providing said handle with a handgrip below said crosspiece.

10. A method as in claim 1, including the steps of:

providing said handle with a T-shaped configuration; and attaching said loop to a top of said T-shaped configuration.

11. A method as in claim 1, including:

providing on said sound-emissive, tear-resistant sheet of material a message visually perceptible by people being entertained and related to an aspect of the people entertainment practiced by said method.

12. A method as in claim 11, including the step of:

holding said handle; and shaking said handle and thereby said loop intensively to draw people's attention to said message by exciting said bent sheet into sound emission through said shaking.

13. A people entertainment noisemaker device, comprising in combination:

a handle; and a single loop of a single sound-emissive, tear-resistant sheet of material attached to said handle;

said loop bent around a space running transversely to said loop and being open to atmosphere laterally of said loop.

14. A device as in claim 13, wherein:

said handle has a crosspiece; and said loop of a sound-emissive sheet of material is attached to said crosspiece of the handle.

15. A device as in claim 14, wherein:

said handle has a handgrip below said crosspiece.

16. A device as in claim 14, wherein:

said crosspiece has grooves; and opposite edges of said sheet of material are in said grooves.

17. A device as in claim 13, including:

streamer elements connected to said handle.

18. A device as in claim 17, wherein:

said streamer elements are attached to said handle.

19. A device as in claim 17, wherein:

said streamer elements are attached to said sheet which is attached to said handle.

20. A device as in claim 17, wherein:

said streamer elements are integral with said sheet which is attached to said handle.

21. A people entertainment noisemaker device, comprising in combination:

a handle;

a single loop of a single sound-emissive, tear-resistant sheet of material attached to said handle, said loop bent around a space running transversely to said loop and being open to atmosphere laterally of said loop; and a message visually perceptible on said sound-emissive, tear-resistant sheet of material by people being entertained and related to an aspect of the people entertainment performed by said device.

22. A device as in claim 21, including:

streamer elements connected to said handle.

* * * * *